US010665957B1

(12) United States Patent
Seller et al.

(10) Patent No.: US 10,665,957 B1
(45) Date of Patent: May 26, 2020

(54) ANGLE INTERCONNECT FOR CARD BASED ANTENNA ARRAY

(71) Applicant: Rockwell Collins, Inc., Cedar Rapids, IA (US)

(72) Inventors: Scott J. Seller, Lisbon, IA (US); Russell C. Tawney, Cedar Rapids, IA (US); Matilda G. Livadaru, Marion, IA (US); Jeremiah D. Wolf, Atkins, IA (US); Alexander D. Johnson, Oakdale, CT (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 11 days.

(21) Appl. No.: 15/909,825

(22) Filed: Mar. 1, 2018

(51) Int. Cl.
*H01Q 1/12* (2006.01)
*H01Q 21/00* (2006.01)
*H01Q 21/06* (2006.01)

(52) U.S. Cl.
CPC ..... *H01Q 21/0031* (2013.01); *H01Q 1/1207* (2013.01); *H01Q 21/061* (2013.01)

(58) Field of Classification Search
CPC . H01Q 21/0031; H01Q 21/061; H01Q 1/1207
See application file for complete search history.

(56) References Cited

U.S. PATENT DOCUMENTS 5,786,792 A * 7/1998 Bellus ..... H01Q 13/085 343/767
6,111,760 A * 8/2000 Nixon ..... H05K 5/0013 220/4.02
2010/0033262 A1* 2/2010 Puzella ..... H01Q 21/0087 333/33
2018/0053997 A1* 2/2018 Noto ..... H03F 1/32

* cited by examiner

*Primary Examiner* — Awat M Salih
(74) *Attorney, Agent, or Firm* — Donna Suchy

(57) ABSTRACT

An antenna array and a method of making can use solder connections. The antenna system includes a back plane circuit board having a top surface, first radio frequency circuit boards arranged in rows on the back plane circuit board and perpendicular to the top surface, and second radio frequency circuit boards arranged in columns on the back plane circuit board and perpendicular to the top surface. Each of the first radio frequency circuit boards include at least one first antenna element, and each of the second radio frequency circuit boards include at least one second antenna. The first radio frequency circuit boards and second radio frequency circuit boards are connected to the back plane circuit board by solder connections.

20 Claims, 4 Drawing Sheets

ANGLE INTERCONNECT FOR CARD BASED ANTENNA ARRAY

BACKGROUND

Embodiments of inventive concepts disclosed herein relate generally to antenna arrays and more particularly to card based antenna arrays including but not limited to ultra-wideband (UWB) apertures.

Modern sensing and communication systems may utilize various types of antennas to provide a variety of functions, such as communication, radar, and sensing functions. For example, wide band arrays are used in electronic intelligence (ELINT) sensors and high data rate communication systems. In another example, radar systems use antenna arrays to perform functions including but not limited to, sensing, intelligence-gathering (e.g., signals intelligence, or SIGINT), direction finding (DF), electronic countermeasure (ECM) or self-protection (ESP), electronic support (ES), electronic attack (EA) and the like. Extensive touch labor assembly is required for connection components of the card based and non-card based arrays and expensive discrete components such as baluns, cables, and connectors behind the aperture are required to transfer energy to backend circuitry. Such components also add to the weight of the antenna array.

SUMMARY

In one aspect, embodiments of the inventive concepts disclosed herein are directed to an antenna array. The antenna array includes a circuit board having a top surface having a ground plane conductor. The ground plane conductor includes apertures arranged in an array formation, and a signal pad is disposed in each of the apertures. The antenna array also includes circuit board cards disposed perpendicular with respect to the top surface. Each of the circuit board cards are coupled to a respective signal pad via a respective solder connection and attached to the top surface at the respective signal pad via the respective solder connection. Each of the circuit board cards comprises an antenna element.

In a further aspect, embodiments of the inventive concepts disclosed herein are directed to an antenna array. The antenna array includes a substrate circuit board having a top surface, first vertical circuit boards arranged in rows on the substrate circuit board and perpendicular to the top surface, and second vertical circuit boards arranged in columns on the substrate circuit board and perpendicular to the top surface. Each of the first vertical circuit boards include a first set of antenna elements provided along a respective row of the rows, and each of the second vertical circuit boards include a second set of antenna elements provided along a respective column of the columns.

In a further aspect, embodiments of the inventive concepts disclosed herein are directed to an antenna system. The antenna system includes a back plane circuit board having a top surface, first radio frequency circuit boards on the back plane circuit board and perpendicular to the top surface, and second radio frequency circuit boards on the back plane circuit board and perpendicular to the top surface. Each of the first radio frequency circuit boards include at least one first antenna element, and each of the second radio frequency circuit boards include at least one second antenna. The first radio frequency circuit boards and second radio frequency circuit boards are connected to the back plane circuit board by solder connections between respective radio frequency signal pads on the first radio frequency circuit boards and the second radio frequency circuit boards and respective radio frequency signal pads on the back plane circuit board.

In a further aspect, embodiments of the inventive concepts disclosed herein are directed to a method of making an antenna system. The antenna system includes a back plane circuit board having a top surface, first radio frequency circuit boards arranged in rows on the back plane circuit board and perpendicular to the top surface, and second radio frequency circuit boards arranged in columns on the back plane circuit board and perpendicular to the top surface. The method includes making a connection using ball grid array technology between the top surface of the back plane circuit board and the first and second radio frequency circuit boards.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or maybe represented schematically in the interest of clarity. Like reference numerals in the drawings may represent and refer to the same or similar element, feature, or function. In the drawings.

DETAILED DESCRIPTION

Figure 1:
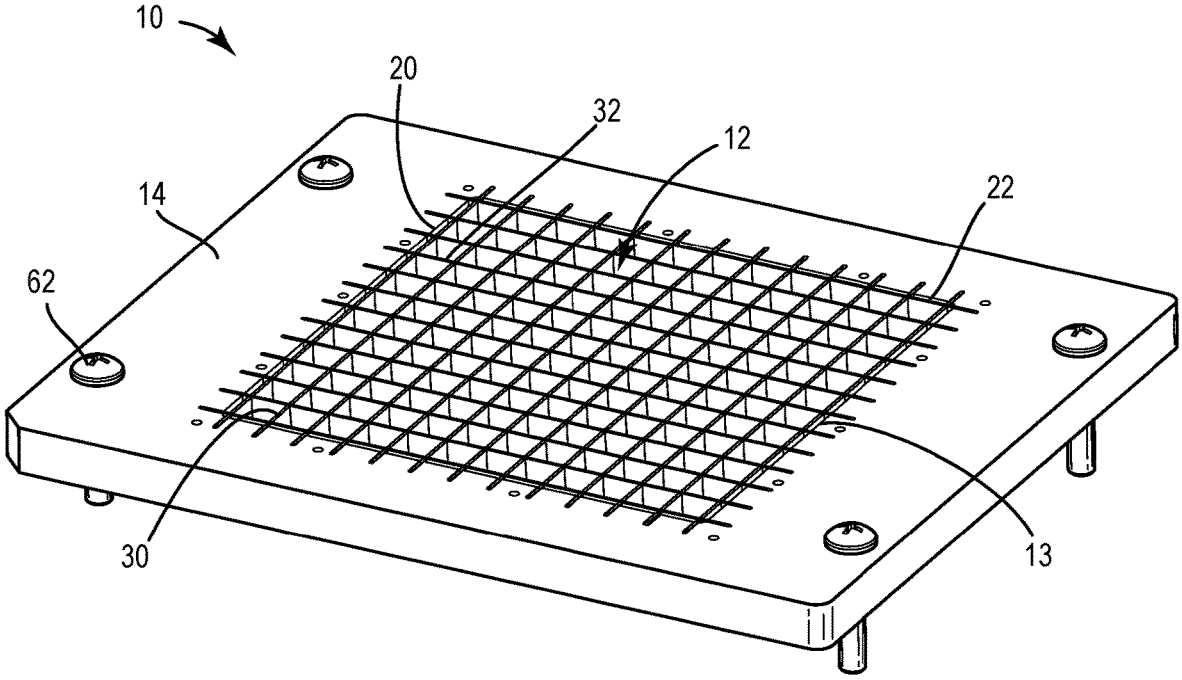
FIG. 1 is a top schematic perspective view of an antenna system according to exemplary aspects of the inventive concepts disclosed herein.

Before describing in detail embodiments of the inventive concepts disclosed herein, it should be observed that the inventive concepts disclosed herein include, but are not limited to a novel structural combination of components and circuits disclosed herein, and not to the particular detailed configurations thereof. Accordingly, the structure, methods, functions, control and arrangement of components and circuits have, for the most part, been illustrated in the drawings by readily understandable representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims. The terms horizontal and vertical are used herein to designate two elements or features that are oriented substantially orthogonally to one another, and do not necessarily denote any particular orientation of the various elements in reference to an external coordinate system or direction.

Some embodiments of the inventive concepts disclosed herein are directed to an antenna system including arrays of circuit card antenna elements for supporting very broad bandwidth operations for a radar, sensing, communication, countermeasure, discovery and/or networking system. The antenna system is utilized as a common shared asset aperture that provides multifunctional, multi-beam support to facilitate multiband communications or operations in some embodiments.

In some embodiments, low cost ultra-wide band arrays are provided using circuit cards including antenna elements connected to a back plane or substrate circuit board in perpendicular fashion. In some embodiments, ball grid array (BGA) solder technology for integrated circuit packaging is used to make the connections. The connections can be the only connections between the circuit cards including the antenna elements and the back plane card (e.g., no discrete connectors) in some embodiments. In some embodiments, the antenna elements are provided on a breakout card. The energy from a printed transmission line or a strip line is provided through a BGA connection onto the feed of a vertical antenna element on the break out card in some embodiments. The right angle transition (horizontal-to-vertical plane) allows for a controlled impedance transition in some embodiments.

In some embodiments, automated assembly of the circuit board cards including the antenna elements and the back plane card including the ground plane is compatible with conventional PCB technology. The approach is scalable both in size, allowing for increased aperture area and in frequency and compatible with single-ended and differentially-fed signals in some embodiments. The antenna system allows for tight integration with beamforming circuitry in some embodiments.

Figure 2:
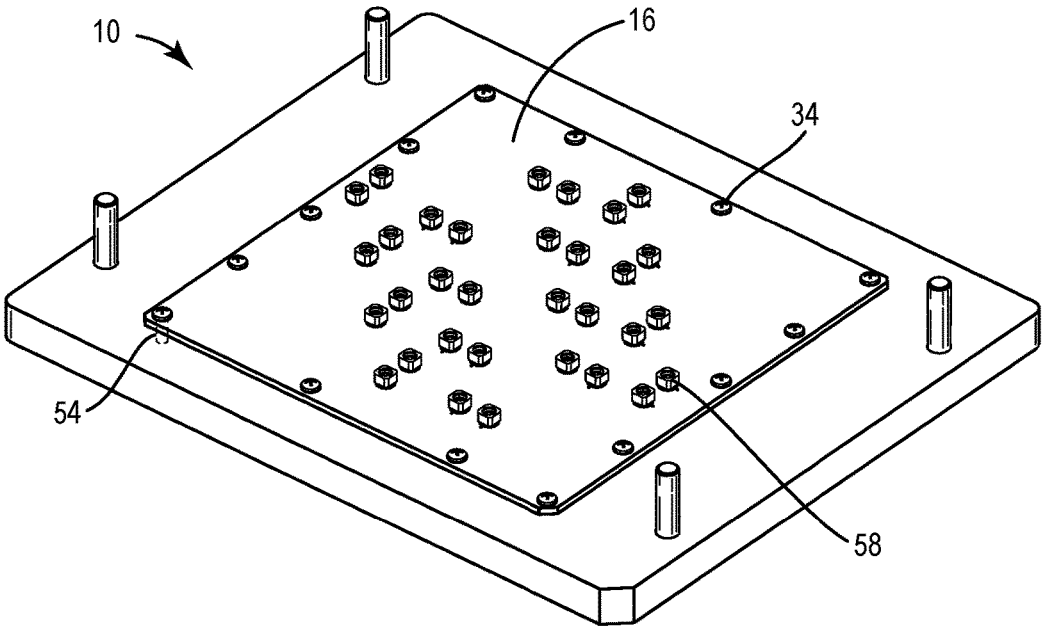
FIG. 2 is a bottom schematic perspective view of the antenna system illustrated in FIG. 1.
Figure 3:
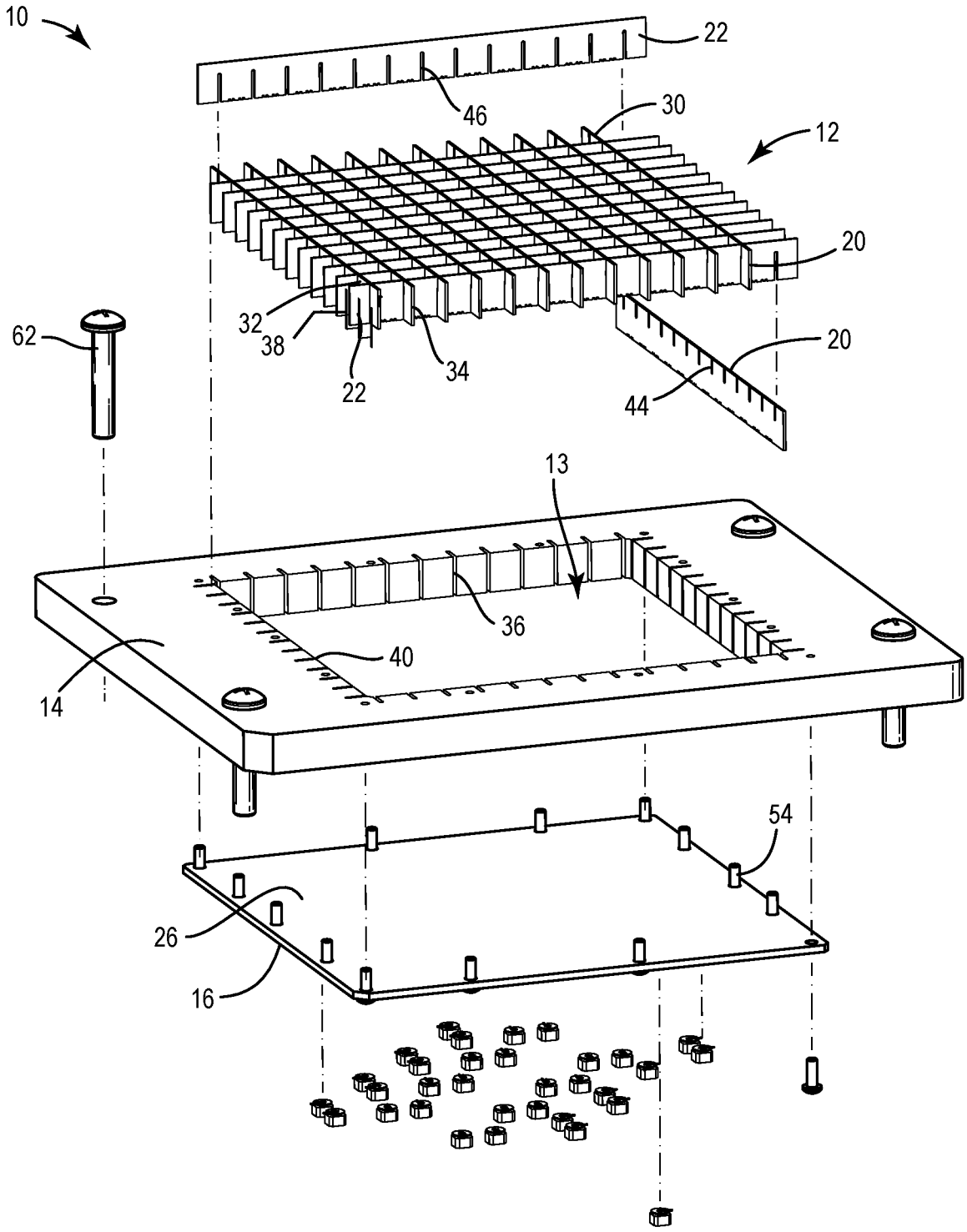
FIG. 3 is a schematic exploded perspective view of the antenna system illustrated in FIG. 1.

Referring to FIGS. 1, 2 and 3, an antenna system 10 for a communication or sensing system includes an antenna array 12, a support chassis 14, and a substrate or back plane circuit board 16 (FIGS. 2 and 3) in some embodiments. The antenna array 12 is disposed in an aperture 13 of the support chassis 14. The antenna array 12 and the aperture 13 are square or rectangular shaped in some embodiments. In some embodiments, the antenna array 12 and the aperture 13 have other shapes (e.g., circular, oval, pentagonal, triangular, etc.). In some embodiments, the antenna system 100 is for a sensing radar system or electronic warfare radar. In some embodiments, the antenna array 12 is provided without the support chassis 14.

The antenna array 12 includes a set of circuit boards 20 that house antenna elements and a set of circuit boards 22 that house antenna elements in some embodiments. In some embodiments, the set of circuit boards 20 and the set of circuit boards 22 are disposed in a matrix (e.g., an egg crate arrangement) of rows and columns that are perpendicular to each other. In some embodiments, the circuit boards 20 and 22 are individual tabs or breakout cards disposed in a matrix of row and/or or columns. The circuit boards 20 and 22 are attached by an angle interconnect to the backplane circuit board 16 in some embodiments.

The set of circuit boards 20 and the set of circuit boards 22 are attached to the back plane circuit board 16 using solder material and extend upward from a top surface 26 (FIG. 3) of the back plane circuit board 16 at an angle. In some embodiments, the circuit boards 20 and 22 are disposed at the same angle to the back plane circuit board 16. In some embodiments, the circuit boards 20 and 22 are disposed at the same angle. In some embodiments, the angle is approximately ninety degrees. In some embodiments, the circuit boards 20 and 22 are disposed at different angles with respect to the back plane circuit board 16. In some embodiments, the set of circuit boards 20 and the set of circuit boards 22 are nested with each other so that a top edge 30 of the circuit boards 20 is in the same plane as a top edge 32 of the circuit boards 22. Ends 34 of the circuit boards 20 are disposed in slots 36 of the support chassis 14, and ends 38 of the circuit boards 22 are disposed in slots 40 of the support chassis 14. The slots 44 are U-shaped, and the slots 46 are upside down U-shaped in some embodiments. The support chassis 14 is a nonconductive material (e.g., plastic) in some embodiments.

The set of circuit boards 22 includes antenna elements between neighboring circuit boards 20, and the set of circuit boards 20 includes antenna elements between neighboring circuit boards 22. The antenna elements are printed circuit antenna elements and can be provided on a single side or each side of the circuit boards 20 and 22 in some embodiments. The set of circuit boards 20 and the set of circuit boards 22 are printed wire radio frequency circuit boards in some embodiments. The circuit boards 20 and 22 can house radio frequency circuits for the antenna system 10. The radio frequency circuits include the antenna elements, up and down converters and beam former circuitry in some embodiments. The beam former circuitry is digital or analog in nature with amplitude and time delay (or phase shift) adjustment circuitry in some embodiments. In some embodiments, the beam former circuitry can utilize digital beam forming (DBF) circuits where either direct digital I/Q sampling (e.g., pure DBF) RF down conversion occurs immediately behind each radiating element (hybrid DBF) and radiation beams are formed through DBF techniques. In some embodiments, the beam former circuitry includes arrays of phase shifters and variable gain amplifiers for effecting DBF.

The circuit boards 20 and 22 are 5-30 inch by 0.5 to 4 inch by printed circuit boards (e.g., single layer or multiple layers) including an insulating medium (e.g., FR4 glass epoxy, ceramics, FR5 glass epoxy, polyimide, Teflon, etc.) and conductive (e.g., copper) traces in some embodiments. The circuit boards 20 and 22 are other sizes depending on design parameters in some embodiments. The circuit boards 20 include slots 44 and the circuit boards 22 include slots 46 for a nested arrangement.

The circuit boards 20 and 22 are connected by solder material along the rows and columns to the back plane circuit board 16. Ball grid array (BGA) soldering techniques are used in some embodiment. A solder sphere, half solder sphere or quarter solder sphere provided by BGA techniques are in contact with conductive pads on the circuit boards 20 and 22 and the back plane circuit board 16. The connection is discussed in more detail below with respect to the embodiments discussed with reference to FIG. 4.

The back plane circuit board 16 is a printed circuit board (e.g., single layer or multiple layers) including an insulating medium (e.g., FR4 glass epoxy, ceramics, FR5 glass epoxy, polyimide, Teflon, etc.) and conductive (e.g., copper) traces in some embodiments. The back plane circuit board 16 is a 5 inch to 20 inch by a 5 inch to 20 inch circuit board and is slightly larger than the aperture 13 in some embodiments. The back plane circuit board 16 can be other sizes depending on design parameters in some embodiments. The back plane circuit board 16 includes baseband circuits in some embodiments and can include digital selection circuits, paths and connectors, such as, connectors 58. In some embodiments, radio frequency circuits and frequency conversion circuits can be provided on the back plane circuit board 16. The back plane circuit board 16 includes a large ground plane on the top surface 26. The ground plane has apertures for signal pads that are coupled to signal pads on the circuit boards 20 and 22 by the solder material.

In some embodiments, the antenna system 10 provides a right angle transition interconnect for the array 12 (e.g., a UWB array). A side ball transition (e.g., with a BGA connection) is provided in an automated the manufacturing process for the attachment of the circuit boards 20 and 22 to the back plane circuit board 16. The automated process reduces assembly errors from hand-placing cards and manual soldering that associated with conventional arrays as well as saves weight, cost, and space. The circuit boards 20 and 22 and the back plane circuit board 16 of the antenna system 10 are compatible with automated assembly and advantageously do not require cables, connectors, hand soldering and expensive chassis in some embodiments.

The back plane circuit board 16 is attached to the support chassis 14 by a set of fasteners 54 (e.g., screws, nuts and/or or bolts). The support chassis 14 can connect to a ground substrate by fasteners 62 (e.g., screws nuts and/or or bolts). The ground substrate is a grounded metal material with a hole disposed for access to the connectors 58 in some embodiments. An optional plastic or other light weight protective housing is provided in some embodiments.

The antenna elements on the circuit boards 20 and 22 can have different and various polarizations in some embodiments. In some embodiments, the antenna elements are horizontal and vertical polarization elements (e.g., BAVA elements). In some embodiments, the antenna elements can be of various shapes and sizes according to system parameters and design criteria for the antenna system 10.

In some embodiments, additional antenna arrays (e.g., similar to the antenna array 12) are stacked on top of the antenna system 10. The antenna system 10 is mounted on a conductive metallic surface of an air, maritime, or ground vehicle, a mount structure, a mast, a tower, or a pole in some embodiments.

Figure 4:
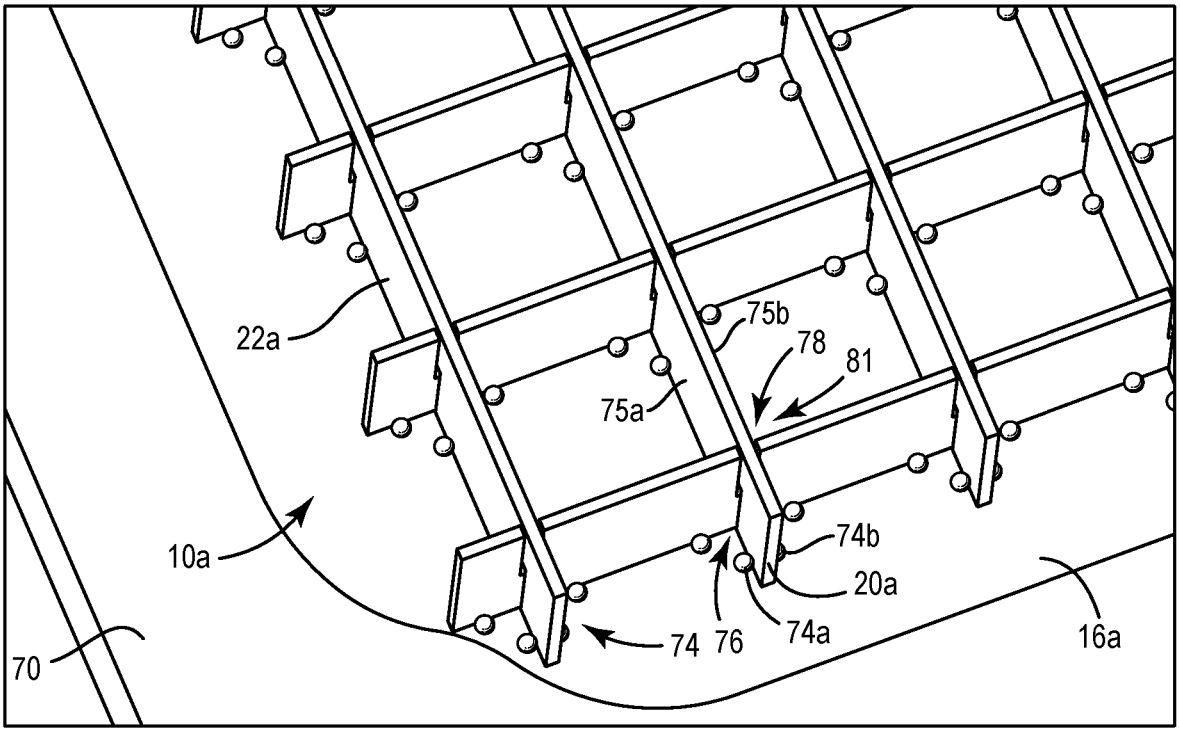
FIG. 4 is a schematic perspective view of a portion of an antenna system according to exemplary aspects of the inventive concepts disclosed herein.

With reference to FIG. 4, a portion 70 of an antenna system 10*a* includes circuit boards 20*a* and 22*a* (similar to the circuit boards 20 and 22, respectively (FIG. 3)) and a back plane circuit board 16*a* (similar to the back plane circuit board 16 (FIG. 3)). The antenna system 10*a* is similar to the antenna system 10 (FIG. 3).

Each of circuit boards 20*a* and 22*b* (e.g., vertical cards) is attached to the back plane circuit board 16*a* by a set of solder connections 74. The connections 74 are quarter spheres of solder material in some embodiments. The connections 74 are formed in a BGA reflow process in some embodiments. In some embodiments, the circuit boards 20*a* and 22*b* can be temporarily held together in a an assembly frame and exposed to a solder bath in some embodiments. In some embodiments, the circuit boards 20*a* and 22*b* and/or the back plane circuit board 16A includes the BGA solder ball and the assembly is subjected to a reflow process to make the connections 74. A support chassis similar to the support chassis 14 can be used to hold the assembly of circuit boards 20*a* and 22*a* together during the reflow process.

In some embodiments, eight solder connections 74 are provided at each intersection of the circuit boards 20*a* and 22*a* (four connections 74 between the circuit board 22*a* and the back plane circuit board 16*a* at each intersection 78 and four connections 74 between the circuit board 20*a* and the back plane circuit board 16*a* at each intersection 78). In some embodiments, two of the connections 74 are provided on each side of the circuit boards 22*a* and 22*b* at each intersection 78. For example, connections 74*a* and 74*b* of the connections 74 connect one of the circuit boards 20*a* at respective sides 75*a* and 75*b* on a side 76 of the intersection 78, and another pair of connections 74 (not shown in FIG. 4 due to the perspective view) connect one of the circuit boards 20*a* at respective sides 75*a* and 75*b* on a side 81 of the intersection 78. Other numbers of connections 74 can be used at each intersection of the circuit boards 22*a* and 22*b*. The connections 74 each provide a separate signal for the antenna elements on the circuit boards 20*a* and 22*a* in some embodiments. In some embodiments, a ground connection is provided to each of the circuit boards 20*a* and 22*a* with a separate connection or as one or more of the connections 74. In some embodiments, the connections 74 are paired to provide a differential signal.

The use of the connections 74 allows the circuit boards 20*a* and 22*a* to be more densely packed because large connectors are not required. More densely packed the circuit boards 20*a* and 22*a* allows for the use of the antenna system 10*a* at higher frequencies in some embodiments.

Figure 5:
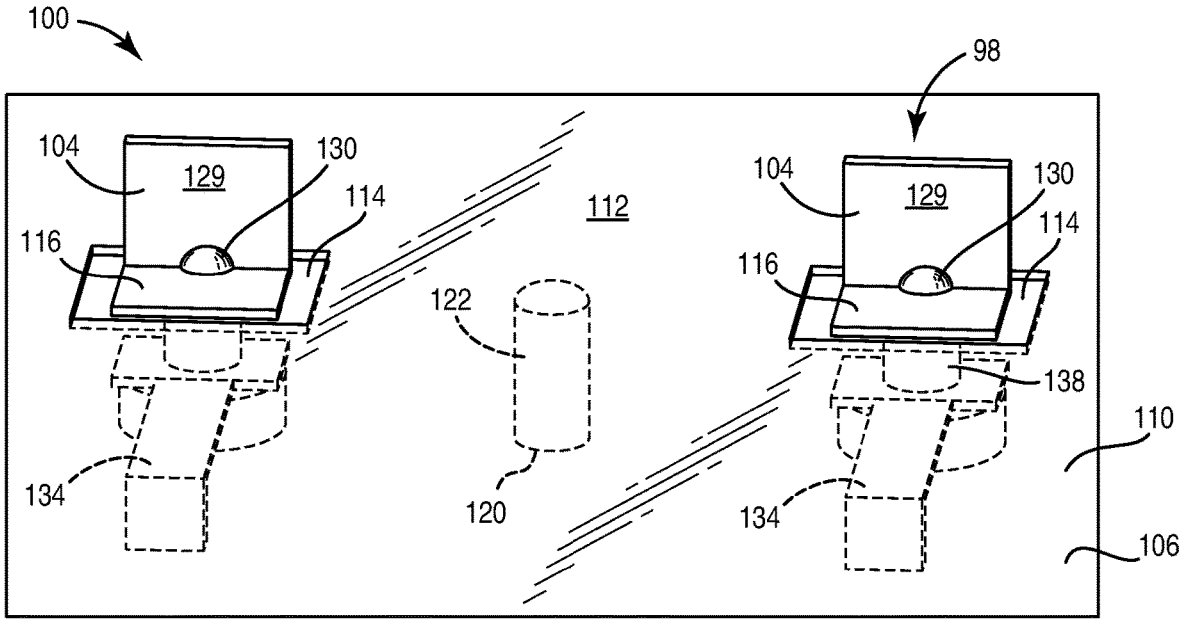
FIG. 5 is a top schematic perspective view of a portion of an antenna system according to exemplary aspects of the inventive concepts disclosed herein.
Figure 6:
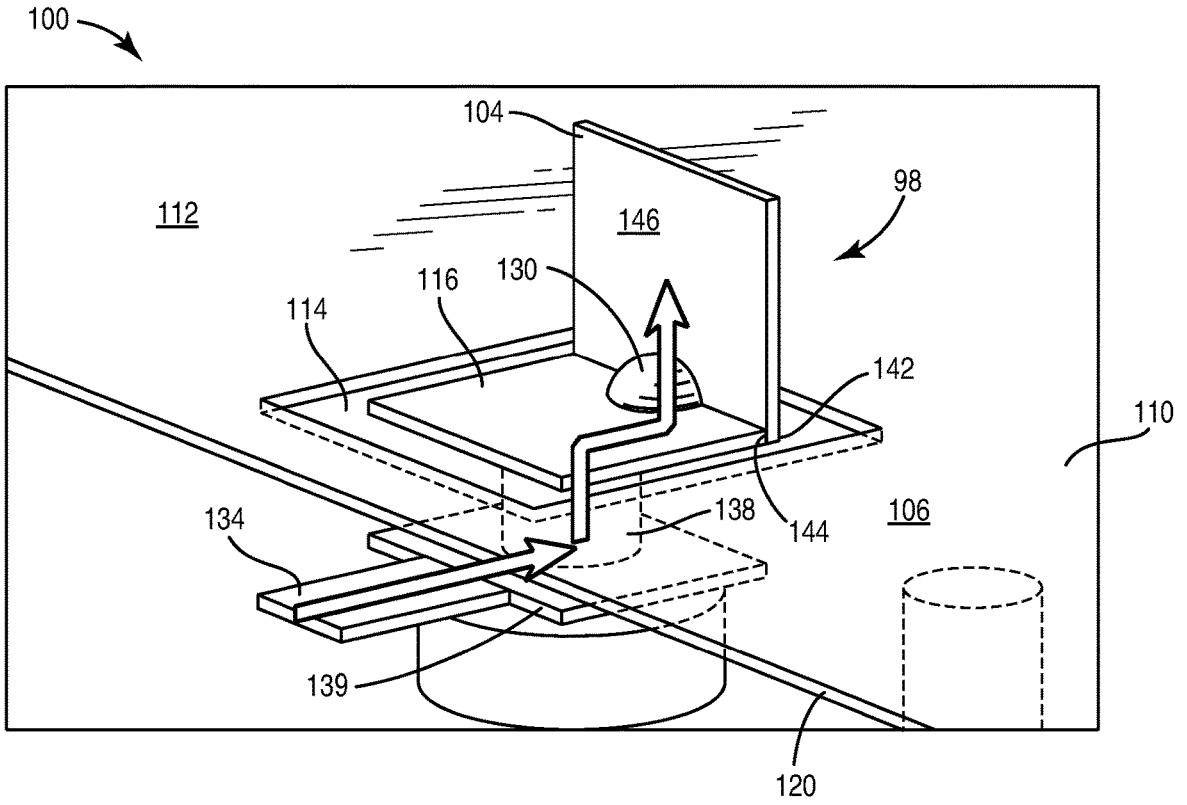
FIG. 6 is a more detailed schematic perspective view of a portion of the portion of the antenna system illustrated in FIG. 1.

With reference to FIGS. 5 and 6, a portion 98 of an antenna system 100. The antenna system 100 is similar to the antenna systems 10 and 10*a* and includes circuit cards 104 and a mother board 106. The mother board 106 is similar to the back plane circuit board 16, and the circuit cards 104 are similar to the circuit boards 20 and 22. The circuit cards 104 are provided at individual locations along rows and/or columns on a top surface 110 of the mother board 106 (e.g., as break out cards or tabs). The circuit cards 104 are attached by an angle interconnect to the mother board 106.

The top surface 110 includes a ground plane 112 that has apertures 114 for signal pads 116. The ground plane 112 is coupled to a ground signal on a bottom surface 120 of the mother board 106 by a conductive via 122. The conductive via 122 is formed from a drilled hole with plated sides in some embodiments. The bottom surface 120 of the mother board 106 also includes a ground plane in some embodiments. The pads 116 and the ground plane 112 can include one or more of lead solder, lead free solder, gold (electrolytic nickel gold), immersion gold (electroless nickel gold), wire bondable gold (99.99% pure gold), immersion silver, flash gold, immersion tin (white tin), carbon ink, and an alloy of tin, copper, and nickel.

The circuit cards 104 include an antenna element. A pad or a conductive area for the antenna element is coupled to the signal pad 116 by a solder connection 130. The solder connection 130 is a one quarter sphere BGA solder connection in some embodiments. In some embodiments, the entire card 104 is the antenna element. In some embodiments, the card 104 is a metal plate, a printed circuit board with a lithographically formed copper or other metal antenna element, or a plastic member with an embedded metal element serving as the antenna element.

The pads 116 are coupled to respective antenna feeds 134 by respective conductive vias 138 and pads 139. The antenna feed 134 is provided on the bottom surface 120 in some embodiments. The antenna feeds 134 can be disposed on the bottom surface 120 or an intermediate surface in some embodiments. In some embodiments, a bottom layer is a ground plane below the antenna feeds 134.

In some embodiments, edges 142 of the cards 104 are disposed on a dielectric medium within the apertures 114. The large planar surfaces 129 of the cards 104 engage the connection 130 and the edges 144 of the pads 116 in some embodiments. The arrangement for connecting cards 104 to the mother board 106 can be used to connect the circuit boards 20, 20*a* and 22,22*a* to the back plane circuit boards 16,16*a* (FIGS. 3 and 4). In some embodiments, the edges 142 engage the top surface of the signal pads 116.

Parameters associated with the antenna systems 10, 10*a*, and 100 can vary based on the operating frequencies supported by the antenna system 10, 10*a*, or the antenna system 100. The specific values of the array parameters described above are exemplary.

The construction and arrangement of the systems and methods as shown in the various exemplary embodiments are illustrative only. For example, although specific shapes of array 12 are discussed, other shapes can be utilized. Although only a number of embodiments have been described in detail in this disclosure, many modifications are possible (e.g., variations in sizes, dimensions, structures, shapes and proportions of the various elements, values of parameters, mounting arrangements, use of materials, orientations, etc.). For example, the position of elements may be reversed, flipped, or otherwise varied and the nature or number of discrete elements or positions may be altered or varied. Accordingly, all such modifications are included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

What is claimed is:

1. An antenna array, comprising:

a circuit board having a top surface having a ground plane conductor, wherein the ground plane conductor includes a plurality of apertures arranged in an array formation, wherein each of a plurality of signal pads is disposed in each of the apertures; and a plurality of circuit board cards disposed perpendicular with respect to the top surface, wherein each of the circuit board cards are coupled to a respective signal pad of the plurality of signal pads disposed in the apertures via a respective solder connection and attached to the top surface at the respective signal pad via the respective solder connection, wherein each of the circuit board cards comprises an antenna element, wherein first circuit board cards of the circuit board cards comprise a first set of first slots and second circuit board cards of the circuit board cards comprise a second set of second slots, wherein the first set of first slots receives the second set of second slots to provide a nested arrangement, wherein the nested arrangement and the solder connection for each of the circuit boards cards provide structural support for the antenna array.

2. The antenna array of claim 1, wherein the solder connection is a ball grid array technology connection.

3. The antenna array of claim 2, wherein the feed conductors are coupled to the signal pads by a plurality of conductive vias.

4. The antenna array of claim 1, wherein an edge of each of the circuit board cards is in contact with a dielectric medium of the circuit board in an associated aperture of the ground plane conductor.

5. The antenna array of claim 1, wherein an edge of each of the signal pads is in contact with a main planar surface of a respective circuit board card of the circuit board cards, the main planar surface of the respective circuit board card including the antenna element.

6. The antenna array of claim 5, wherein a bottom surface of the circuit board comprises a plurality of feed conductors, wherein each of the respective feed conductors is coupled to each respective pad.

7. An antenna array, comprising:

a substrate circuit board having a top surface;

a plurality of first vertical circuit boards arranged in rows on the substrate circuit board and perpendicular to the top surface, each of the first vertical circuit boards comprising a first set of antenna elements provided along a respective row of the rows; and a plurality of second vertical circuit boards arranged in columns on the substrate circuit board and perpendicular to the top surface, each of the second vertical circuit boards comprising a second set of antenna elements provided along a respective column of the columns wherein the first vertical circuit boards and the second vertical circuit boards are connected to the substrate circuit board by solder connections between respective signal pads on the first vertical circuit boards and the second vertical circuit boards and respective signal pads on the substrate circuit board, wherein the first vertical circuit boards comprise a first set of first slots and the second vertical circuit boards comprise a second set of second slots, wherein the first set of first slots receives the second set of second slots to provide a nested arrangement, wherein the nested arrangement and the solder connections provide structural support for the antenna array.

8. The antenna array of claim 7, wherein the first vertical circuit boards and the second vertical circuit boards are connected to the substrate circuit board.

9. The antenna array of claim 7, wherein the first vertical circuit boards each include a plurality of first slots corresponding to locations of the second vertical circuit boards.

10. The antenna array of claim 9, wherein the second vertical circuit boards each include a plurality of second slots corresponding to locations of the first vertical circuit boards.

11. The antenna array of claim 9, wherein a first top edge of the second vertical circuit boards is in a same plane as a second top edge of the first vertical circuit boards.

12. The antenna array of claim 7, wherein at least four solder connections are disposed at each intersection of one of the second vertical circuit boards and one of the first vertical circuit boards.

13. An antenna system, comprising:

a back plane circuit board having a top surface;

a plurality of first radio frequency circuit boards disposed on the back plane circuit board and perpendicular to the top surface, each of the first radio frequency circuit boards comprising at least one first antenna element; and a plurality of second radio frequency circuit boards disposed on the back plane circuit board and perpendicular to the top surface, each of the second radio frequency circuit boards comprising at least one second antenna element, wherein the first radio frequency circuit boards and the second radio frequency circuit boards are connected to the back plane circuit board by solder connections between respective radio frequency signal pads on the first radio frequency circuit boards and the second radio frequency circuit boards and respective radio frequency signal pads on the back plane circuit board, wherein the first radio frequency circuit boards comprise a first set of first slots and the second radio frequency circuit boards comprise a second set of second slots, wherein the first set of first slots receives the second set of second slots to provide a nested arrangement, wherein the nested arrangement and the solder connections provide structural support for the antenna system.

14. The antenna system of claim 13, further comprising a support chassis having a central aperture, wherein the first radio frequency circuit boards and the second radio frequency circuit boards are disposed in the central aperture.

15. The antenna system of claim 14, wherein the support chassis further comprises slots about a periphery of the central aperture for receiving ends of the first radio frequency circuit boards and the second radio frequency circuit boards.

16. The antenna system of claim 15, wherein the support chassis is attached to the back plane circuit board by fasteners around the periphery of the central aperture, the central aperture being rectangular.

17. The antenna system of claim 13, wherein the first radio frequency circuit boards and the second radio frequency circuit boards are nested together and form rows and columns on top of the top surface.

18. The antenna system of claim 13, further comprising a support chassis comprising slots for receiving ends of the first radio frequency circuit boards and the second radio frequency circuit boards.

19. The antenna system of claim 13, further comprising connectors on a bottom surface of the back plane circuit board.

20. The antenna system of claim 13, wherein frequency conversion circuit and phase shift element are provided on the first radio frequency circuit boards and the second radio frequency circuit boards.

* * * * *